US005399077A

United States Patent [19]

Renger et al.

[11] Patent Number: 5,399,077

[45] Date of Patent: Mar. 21, 1995

[54] VARIABLE CAPACITY VANE PUMP

[75] Inventors: Gerald Renger, Stuttgart; Arno Roehringer, Ditzingen, both of Germany

[73] Assignee: Mercedes-Benz Ag, Stuttgart, Germany

[21] Appl. No.: 195,462

[22] Filed: Feb. 14, 1994

[30] Foreign Application Priority Data

Feb. 12, 1993 [DE] Germany ..... 43 04 208.2

[51] Int. Cl.[6] ..... F01C 21/16

[52] U.S. Cl. ..... 418/28; 418/24

[58] Field of Search ..... 418/24, 28; 417/212

[56] References Cited

U.S. PATENT DOCUMENTS 1,659,753 8/1926 Thompson .
2,448,108 8/1948 McCaleb ..... 418/28
4,492,541 1/1985 Mallen-Herrero et al. .
4,551,080 11/1985 Geiger ..... 418/28

FOREIGN PATENT DOCUMENTS 1065243 9/1959 Germany .
2061385 6/1972 Germany .
4120757 1/1992 Germany .

*Primary Examiner*—Richard A. Bertsch
*Assistant Examiner*—Charles G. Freay
*Attorney, Agent, or Firm*—Evenson, McKeown, Edwards & Lenahan

[57] ABSTRACT

The invention relates to a vane pump, the volumetric delivery of which can be regulated by varying the axial width of the pump working chambers. The vanes are carried in an axially fixedly disposed vane-carrier which rotates with the rotor. An axial slide engages axial ends of the respective individual vanes to axially movably adjust the vanes and therewith the axial length of the pump working chambers.

7 Claims, 2 Drawing Sheets

VARIABLE CAPACITY VANE PUMP

BACKGROUND AND SUMMARY OF THE INVENTION

The invention relates to a vane pump having an annular cam fixedly disposed in a pump housing and a rotor which is regionally surrounded by the annular cam and has axial slots. Vanes are radially displaceable in the slots and are guided by their radial outer margins on the annular cam. The vanes separate pump working chambers from one another in an annular space left radially between the annular cam and a rotor part surrounded by the annular cam. The rotor possesses, axially next to the annular cam, a further rotor part of large diameter which is at least equally as large as the maximum diameter of the annular cam relative to the rotor axis, the slots in the rotor part surrounded by or enclasped by the annular cam continue axially and in a radially outward direction into the further rotor part. On that end face of the rotor facing away from the further rotor part there is disposed an axial slide of annular cross-section, the outer contour of which corresponds to the inner contour of the annular cam and the inner contour of which corresponds to the circular outer contour of the rotor part enclasped by the annular cam. The axial distance between the further rotor part and the facing end face of the axial slide is adjustable, regions of the vanes being able to slide, according to the adjustment of the axial slide, axially into the slots in the further rotor part or axially out of these slots.

A corresponding vane pump is the subject of German Patent Document DE-A 20 61 385. A design of this type is advantageous insofar as the volumetric displacement of the pump is continuously variable by adjustment of the axial slide and the annular cam can have, in principle, any chosen cross-section, such that, when the pump is running, a good mechanical balance of the vanes moving in the radial direction and an extensive .compensation of the fluidic forces acting upon the rotor are made possible.

In pumps of this type, however, the guidance of the vanes is critical. The vanes according to German Patent Document DE-A 20 61 385, for instance, have to be guided in the radial direction between axially movable parts.

The same basically applies to a vane pump known from U.S. Pat. No. 1,659,753, in which the effective axial width of the pump working chambers is likewise variable.

In a vane pump known from German Patent Document DE-B 10 65 243, the pump working chambers of which exhibit a variable axial width, although the vanes are guided radially on rotor fixed parts, the annular cam must nevertheless be movably disposed.

In addition, as technological background to the vane pump, reference is also made to German Patent Document DE-A 41 20 757, in which there is represented a vane pump, the pump working spaces of which exhibit a non-variable axial width.

An object of the invention is now to provide a new vane pump of the type specified in the introduction, in which the movements of the vanes, in particular, are designed to proceed with high precision.

This object is achieved according to the invention by the fact that the vanes respectively comprise a vane-carrier part and a vane part, the vane-carrier part, which is axially retained between stationary parts on the end face of the rotor and is only radially movable, remaining in all radial settings within the slots and the vane part, which is guided radially on the annular cam and bears against the adjacent end wall of the axial slide, being guided axially displaceably on the vane-carrier part.

Based on the construction according to the invention, a particularly good guidance of the vanes is achieved. Since the vane-carrier parts, in their movements in the radial direction, are guided by stationary parts, any tilting movements about an axis perpendicular to the plane of the vane can be virtually fully precluded. This also simultaneously has the effect that the vane parts, which are axially displaceable in the vane-carrier parts, are likewise prevented from corresponding tilting movements, to be precise even when these vane parts, upon a correspondingly large adjustment of the axial slide in the direction of a low pump delivery, are forced with just a narrow lateral region against the annular cam.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
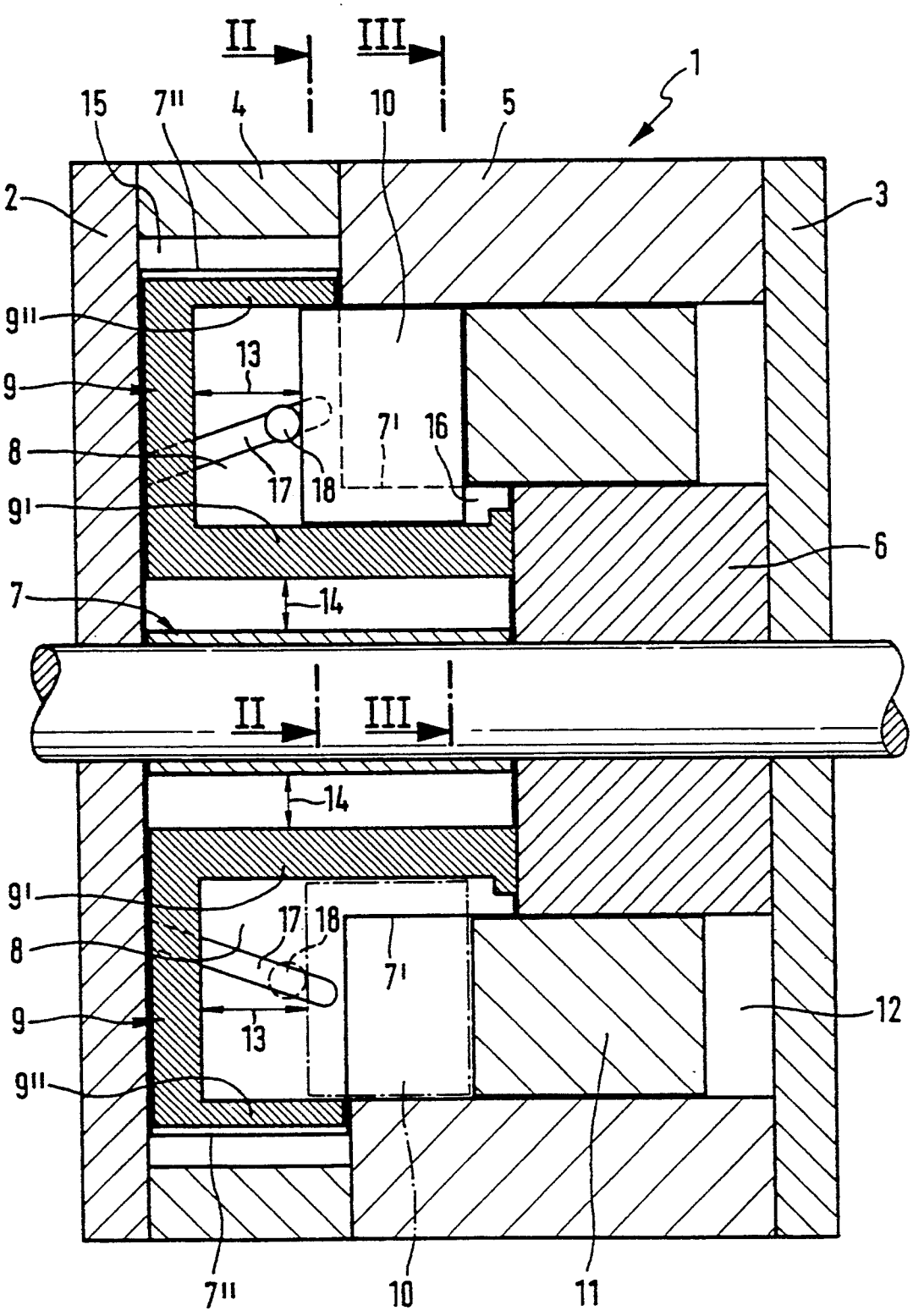
FIG. 1 is an axial sectional vie of a pump constructed according to a preferred embodiment of the invention.
Figure 2:
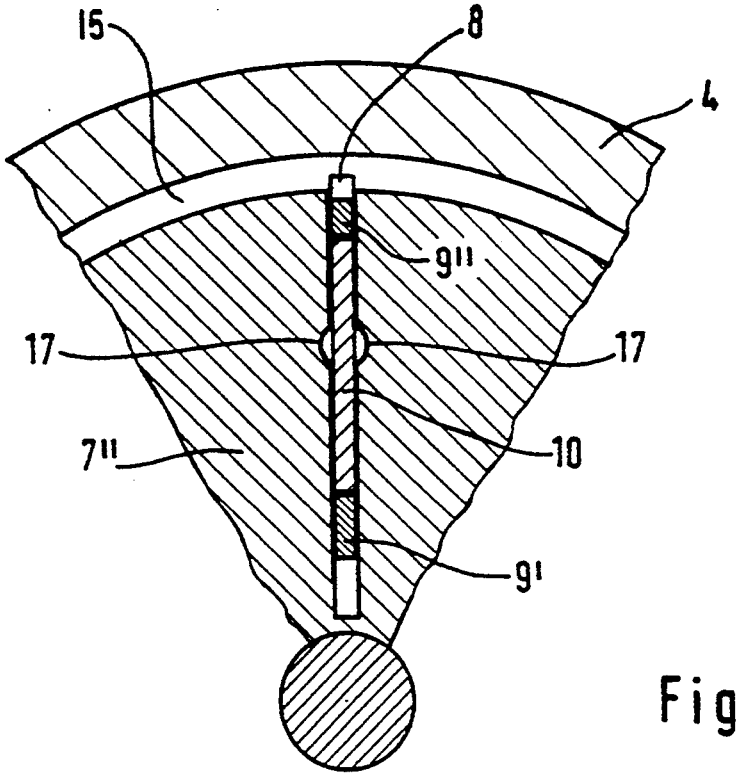
FIG. 2 is a cross-section according to the sectional plane II—II in FIG. 1.
Figure 3:
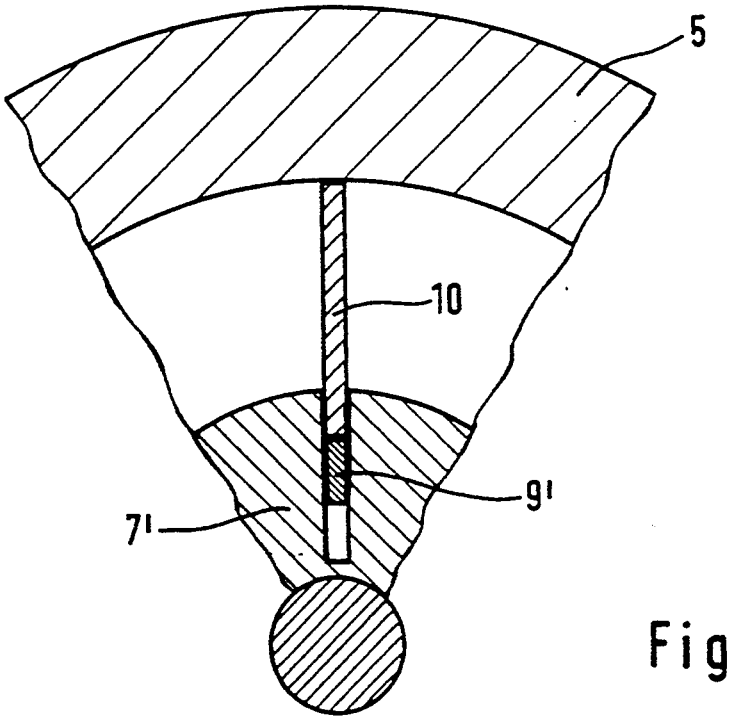
FIG. 3 shows a cross-section corresponding to the sectional line III—III in FIG. 1.

The pump possesses a housing 1 essentially comprising two ends walls 2 and 3 and, between these end walls 2 and 3, an annular part 4 and an annular cam 5. The annular part 4 possesses an inner peripheral wall of circular cross-section, while the annular cam 5 exhibits an inner peripheral wall of non-circular cross-section, for example of approximately oval cross-section.

On the inner side of the end wall 3 there is centrically disposed a guide cylinder 6 which is circular in cross-section.

Rotatably mounted between the end wall 2 and the facing end face of the guide cylinder 6 there is a rotor 7, which possesses a part 7' radially within the annular cam 5 and a part 7'' radially within the annular part 4. The rotor part 7' possesses the same diameter as the guide cylinder 6. The rotor part 7'' possesses an outer diameter which is everywhere somewhat larger than the maximum inner diameter of the annular cam 5.

Within the rotor 7 there are disposed axial slots 8, which permeate the rotor 7 over its entire axial length. These slots 8 are disposed, in the front view of the rotor 7, in each case at equal angles relative to one another.

Within the slots 8 there are disposed vanes comprising a vane-carrier part 9 and a vane part 10.

The vane-carrier part 9 possesses a substantially rectangularly configured C-form, a long leg 9' extending axially between the end wall 2 and the facing end face of the guide cylinder 6, while a shorter leg 9'' is disposed axially between the end wall 2 and the facing end face of the annular cam 5. The distance between these legs 9' and 9'' of the vane-carrier part in the radial direction of the rotor 7 is dimensioned such that the vane-carrier part 9 is radially displaceable within the assigned slot 8 of the rotor 7, the leg 9' remaining constantly within the outer contour of the rotor part 7'.

Any axial displacement of the vane-carrier part 9 is prevented by its axial support against the end wall 2 and against the facing end face of the guide cylinder 6 and of the annular cam 5.

Between the legs 9' and 9'' of the vane-carrier part there is disposed, axially displaceably, the rectangular vane part 10, the path of displacement being dimensioned such that the vane part 10 is constantly covered over somewhat, with respect to its left margin, in the drawing, by the rotor part 7''.

During running of the pump, the radially outer margin of the vane part 10 slides over the inner side of the annular cam 5 and thus determines the radial position of the vane part 10 and of the associated vane-carrier part 9.

The axial position of the vane part 10 is determined by an axial slide 11, which is disposed as an annular piston in the annular space between the guide cylinder 6 and the annular cam 5 and accordingly possesses an outer peripheral surface (of non-circular cross-section) matched to the annular cam 5 and an inner-peripheral surface (of circular cross-section) matched to the outer peripheral wall of guide cylinder 6. That end face of the axial slide 11 facing the end wall 2 forms a radial plane relative to the rotor axis, enabling the adjacent lateral margin of the vane parts 10 to bear tightly upon this end face.

The axial position of the axial slide 11 can be hydraulically controlled by hydraulic medium being introduced into an annular chamber 12 closed off, in a piston-like manner, by the axial slide 11 or by hydraulic medium being evacuated out of this annular chamber 12.

During running of the pump, the vane parts 10 separate pump working chambers from one another, within the annular space left radially between the rotor part 7' and the annular cam 5 and axially between the rotor part 7'' and the axial slide 11. The size of the working chambers varies, upon the circulation of the rotor 7, according to the respective inner diameter of the annular cam 5. Via inflow and outflow channels (not represented) which can permeate, for example, the annular cam 5 and the plate 2 and rotor 7, these working chambers take up pump medium during a suction phase, which pump medium is subsequently discarded in the direction of the delivery side of the pump upon the further circulation of the rotor 7.

By varying the axial width of these working chambers, i.e., by adjusting the axial slide 11, it is possible to control the volumetric delivery of the pump.

In order to ensure that the vane parts 10 bear tightly in each case against the facing end face of the axial slide 11, the vane parts 10 can be supported by means of springs (not represented) against the middle region of the respectively assigned vane-carrier part 9, between its legs 9' and 9''.

Instead, groove-shaped guide channels 17 can be disposed on the walls of the slots 8, obliquely to the rotor axis, in such a way that a ball 18 guided in the channels 17, due to the rotation-speed-dependent centrifugal force which arises when the rotor 7 is rotating, is forced at a rotation-speed-dependent axial force against the, in FIG. 1, left margin of the respective vane part 10 and the vane part 10 is correspondingly pressed against the axial slide.

Additionally or alternatively, there is the option of configuring the slots 8 or the surfaces of the vane parts 10 such that a distance space 13, which is left between that lateral margin of each vane part 10 facing the end wall 2 and that region of the assigned vane-carrier part 9 parallel to this end wall 2, and a small distance space 16, which is left between the vane part 10 and the guide cylinder 6, communicate in each case, via a connection, with at least one pump working chamber. Hydraulic compression forces can thus be generated in the spaces 13 and 16, the overall effect of which forces is to push the respective vane part 10 against the axial slide 11.

Due to the centrifugal forces which arise when the rotor 7 is rotating, the vane parts 10 are forced inevitably against the inner peripheral side of the annular cam 5.

This contact pressure can be hydraulically reinforced, where necessary, by pressure medium being introduced in each case into the distance space 14 which is left in each of the slots 8 between the floor of the slot and the leg on of the respective vane-carrier part 9. In order to match the pressurization of the face on the radially inner margin of the vane part 10' precisely to the pressurization of that radially outer margin of the vane part bearing against the annular cam, a space 15', which is left between the rotor part 7'' and the annular part 4, can be acted upon by oil of equal pressure to that in the distance space 14.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Vane pump having an annular cam which is fixedly disposed in a pump housing, a rotor which is regionally circumferentially surrounded by the annular cam and has axial slots, and vanes, which are displaceable in the axial slots and are guided by radial outer margins of the vanes on the annular cam, said vanes separating pump working chambers from one another in an annular space left radially between the annular cam and a first rotor part surrounded by the annular cam, wherein the rotor possesses a further rotor part of large diameter axially next to the annular cam which, further rotor part is at least equally as large as a maximum diameter of the annular cam relative to a rotor axis, the slots in the first rotor part surrounded by the annular cam continuing axially and in a radially outward direction into the further rotor part, wherein there is disposed an axial slide of annular cross-section on an end face of the rotor facing away from the further rotor part, an outer contour of which axial slide corresponds to an inner contour of the annular cam and an inner contour of which axial slide corresponds to the circular outer contour of the first rotor part surrounded by the annular cam, wherein an axial distance between the further rotor part and a facing end face of the axial slide is adjustable, the vanes being axially slidable into the slots in the further rotor part or axially out of these slots in response to adjustment of the axial slide, wherein the vanes in each case comprise a vane-carrier part and a vane part, the vane-carrier part being axially retained between stationary parts on the end face of the rotor such that the vane part are only radially moveable, within the slots, wherein the vane part is guided radially on an outside on the annular cam and bears against an adjacent end wall of the axial slide, said vane part being guided axially displaceably on the vane-carrier part.

2. Vane pump according to claim 1, wherein the axial slide closes off a pressure chamber in the manner of a piston such that controllable pressure generated in the pressure chamber tends to push the axial slide in the direction of the further rotor part.

3. Vane pump according to claim 1, wherein the vane-carrier part, with a radially inner margin in the respective rotor slot, closes off a control chamber which is pressurized at a higher fluid pressure when there is an axially large distance between the further rotor part and the axial slide and is pressurized at a lower fluid pressure when there is an axially smaller distance between the rotor part and the axial slide.

4. Vane pump according to claim 2, wherein the vane-carrier part, with its radially inner margin in the respective rotor slot, closes off a control chamber, which, where there is an axially large distance between the further rotor part and the axial slide, can be pressurized at higher fluid pressure and, where there is an axially smaller distance between the rotor part and the axial slide, at lower fluid pressure.

5. Vane pump according to claim 3, wherein the axial displacement of the vanes controls in opposite directions, on the one hand, a connection between the control chamber and an adjacent working chamber of the pump and, on the other hand, a connection between the control chamber and the pressure chamber.

6. Vane pump according to claim 4, wherein the axial displacement of the vanes controls in opposite directions, on the one hand, a connection between the control chamber and an adjacent working chamber of the pump and, on the other hand, a connection between the control chamber and the pressure chamber.

7. Vane pump comprising:

an annular cam fixedly disposed in a pump housing, and a rotor rotatable within said pump housing and carrying a plurality of vanes in rotor slots, which vanes slidably engage the annular cam and serve to separate variable volume pump working chambers during rotation of the rotor, wherein said vanes are carried in a vane assembly including a vane-carrier part which is axially fixed between stationary pump parts and is radially moveable and individual vanes disposed to be axially moveable with respect to the vane-carrier part, and wherein an axially moveable slide is provided for abutting against and axially positioning the individual vanes to thereby vary the pumping volume of the vane pump during pumping operations.

* * * * *